US005259585A

United States Patent [19]

Gregory

[11] Patent Number: 5,259,585

[45] Date of Patent: Nov. 9, 1993

[54] REMOVABLY MOUNTED CHAIR AND APPARATUS FOR REMOVING IT

[76] Inventor: Donald J. Gregory, 19704 Hiawatha Rd., Odessa, Fla. 33556

[21] Appl. No.: 769,461

[22] Filed: Oct. 1, 1991

[51] Int. Cl.[5] ..... A47B 97/00

[52] U.S. Cl. ..... 248/544; 248/501; 248/503.1

[58] Field of Search ..... 248/544, 503, 503.1, 248/506, 680, 681, 500, 501; 296/65.1

[56] References Cited

U.S. PATENT DOCUMENTS

| | | | |
|---|---|---|---|
| 1,165,880 | 12/1915 | Horton | 248/501 |
| 3,652,050 | 3/1972 | Marrujo et al. | 248/501 X |
| 4,759,580 | 7/1988 | Berklich, Jr. et al. | 248/503.1 X |
| 4,789,126 | 12/1988 | Rice et al. | 248/503.1 |
| 4,830,422 | 5/1989 | Levitre | 248/503.1 X |

FOREIGN PATENT DOCUMENTS

| | | | |
|---|---|---|---|
| 1079959 | 12/1954 | France | 248/506 |

*Primary Examiner*—Alvin C. Chin-Shue

*Attorney, Agent, or Firm*—Stanley M. Miller

[57] ABSTRACT

A theater chair is removably mounted to the floor of a theater so that it may be quickly removed when needed to provide space for a patron using a wheelchair. A tool is required to remove the chair from its mount. Holes are formed in the floor of the theater, and each hole is covered with a cover plate. A base plate has a pair of ears attached to its leading edge that engage the front cover plates to hold down the front of the base plate. Rear foot anchors are mounted to the trailing edge of the base plate and these rear foot anchors releasably engage the rear cover plates to hold down the back of the base plate. The rear foot anchors are movably mounted and release the rear cover plates when moved by the tool. The tool includes an elongate rod at the end of a handle so that when the handle is rotated rearwardly, each rear foot anchor is displaced and releases its associated rear cover plate so that the chair can be detached. The chair is also easily reinstalled with the aid of the tool. Numerous embodiments are shown.

12 Claims, 17 Drawing Sheets

REMOVABLY MOUNTED CHAIR AND APPARATUS FOR REMOVING IT

BACKGROUND OF THE INVENTION

1. Field of the Invention

This invention relates, generally, to removably mounted chairs or other objects. In one embodiment, it relates to a theater chair and a device that removes the chair as needed to accommodate wheelchairs.

2. Description or the Prior Art

People who use wheelchairs are often denied access to movie theaters or other theaters of the performing arts because the premises are not equipped to accommodate wheelchairs. In a typical house of the performing arts, or other assembly halls, all available space is occupied by permanently mounted seats. Fire codes do not allow the blocking of aisles by wheelchairs; accordingly, if a person in a wheelchair is unable or unwilling to be removed from the wheelchair and deposited into a seat, that person is unable to see the movie or other performance.

Laws have been enacted in some states that require assembly hall or theater operators to make the facilities accessible by those in wheelchairs. Most owners of such establishments have responded by removing several seats in the back row of seats so that wheelchair patrons can use the space thereby made available. Obviously, if more than one patron in a wheelchair desires to see a show, attend a speech, or the like, only the first to arrive or make reservations may be served. Moreover, a movie or other performance will sometimes play to a sellout crowd, and the space reserved for a wheelchair is unused. The owner of the establishment thus loses revenue and is even more reluctant to remove further seats to accommodate more than one wheelchair.

Thus, there is a problem in the theater industry and wherever permanently mounted seats are found, but the industry has heretofore been unable to develop a solution thereto.

There are also many items other than chairs that need to be securely mounted to a floor or other support surface, yet movable from time to time. For example, coin-operated vending machines, computers in arcades dedicated to game playing, tables in public parks and restaurants, bus seats, and many other items too numerous to mention often require secure mounting, but their utility would be enhanced if they could be removably mounted so that they could be moved by authorized personnel whenever needed.

The teachings and suggestions of the prior art provide no insight as to how chairs and numerous other items could be securely mounted yet removable as needed. Importantly, any acceptable means for removing the item would have to require a special tool so that vandals, pranksters, or thieves could not move such items at will. Just as importantly, the structure which holds down the item should not be visible to the casual observer so that even if a tool capable of removing the item were to fall into the possession of a thief or other unauthorized person, the method of removal of the item with the tool would not be apparent.

The prior art neither teaches nor suggests how such a removable mounting could be accomplished. It follows that the art also does not teach or suggest how a special tool could be provided to accomplish the removal procedure, or how the method of use of the tool could be concealed from unauthorized personnel.

SUMMARY OF THE INVENTION

The invention arises from the insight that the solution to the problem relating to the absence of wheelchair space in public halls resides in the provision of a removably mounted chair. From this initial insight flows the solution to the problem relating to secure yet removable mounts for vending machines and the like.

When no wheelchair-using patrons appear at a show, all of the seats may be filled without a loss of revenue to the owner of the establishment. If one wheelchair-using patron attends the performance, the required number of the novel removable chairs can be removed to accommodate the wheelchair; if two wheelchair-using patrons attend, more chairs can be removed to accommodate the two wheelchairs, and so on. Thus, the establishment is flexible and can adapt to the needs of its patrons as the needs are presented.

The novel chair, advantageously, is designed so that it is easily removed by an employee of the theater, but is not removable by a patron. This is accomplished by mounting the chair such that a special tool is required detach it. The same tool is employed to reinstall the chair when wheelchair-accommodating space is not needed.

The conventional chair is first removed and four holes are formed in the floor in a rectangular array; a cover plate that performs the function of covering the hole and serving as a catch member is then placed into each hole, and a flat base plate is placed into overlying relation to the floor and the cover plates. The cover plates for the rear holes and the front holes are of different construction.

More particularly, the front cover plates passively serve as catch members that are engaged by a pair of forwardly protruding, laterally spaced apart ear members mounted to the underside of the base plate at the leading edge thereof. A pair of rear foot anchors are pivotally mounted to the trailing edge of the base plate and said rear foot anchors are held against retraction by their associated rear catches.

To remove the chair, a novel tool is employed. In most embodiments, the tool has a lateral extent that corresponds to the spacing of the rear holes and hence to the rear cover plates and the rear foot anchors. The tool includes a handle to facilitate its use by a theater employee while standing behind the chair to be removed. In a first embodiment, a rod depends from the opposite, laterally spaced ends of the tool and each rod is inserted through an opening in its associated rear cover plate between an armature that pivotally mounts each rear foot anchor. The employee then rocks the tool rearwardly, i.e., towards him or herself; this motion separates each rear foot anchor from its associated rear catch.

The ears at the leading end of the base plate may then be slid out from under the edge of the front catches and the chair is freed. A pair of wheels are provided on the trailing side of the tool so that the freed chair may be rocked rearwardly onto the tool and carted away. The above-recited procedure is simply reversed when the chair is reinstalled.

Four additional embodiments of the rear foot anchors are also depicted. Each of them securely holds down the trailing edge of the chair until released from its catch by a special tool.

Although the invention is depicted in connection with a chair, it should be understood that the novel structure has application in any context where a mount area is required to remain flush to the surrounding environment. The claims that follow cover the novel structure and as such, all applications of the structure, whether specifically listed herein or not, as a matter of law.

The primary object of this invention is to provide an efficient means whereby theater operators can quickly remove and install theater chairs as needed to meet the needs of their wheelchair-using patrons and their able-bodied patrons as well.

Another important object is to attain the above object with a chair design that prevents chair removal by unauthorized persons.

A more general object is to provide means for securely mounting any item that may require removal at some time, and to provide such means in a way that will foil unauthorized persons in their attempts to accomplish an unauthorized removal of the removably mounted object.

These and many other important objects, features, and advantages of the invention will become apparent as this description proceeds.

The invention accordingly comprises the features of construction, combination of elements and arrangement of parts that will be set forth in the construction hereinafter described, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

DETAILED DESCRIPTION OF THE PREFERRED EMBODIMENTS

Figure 1:
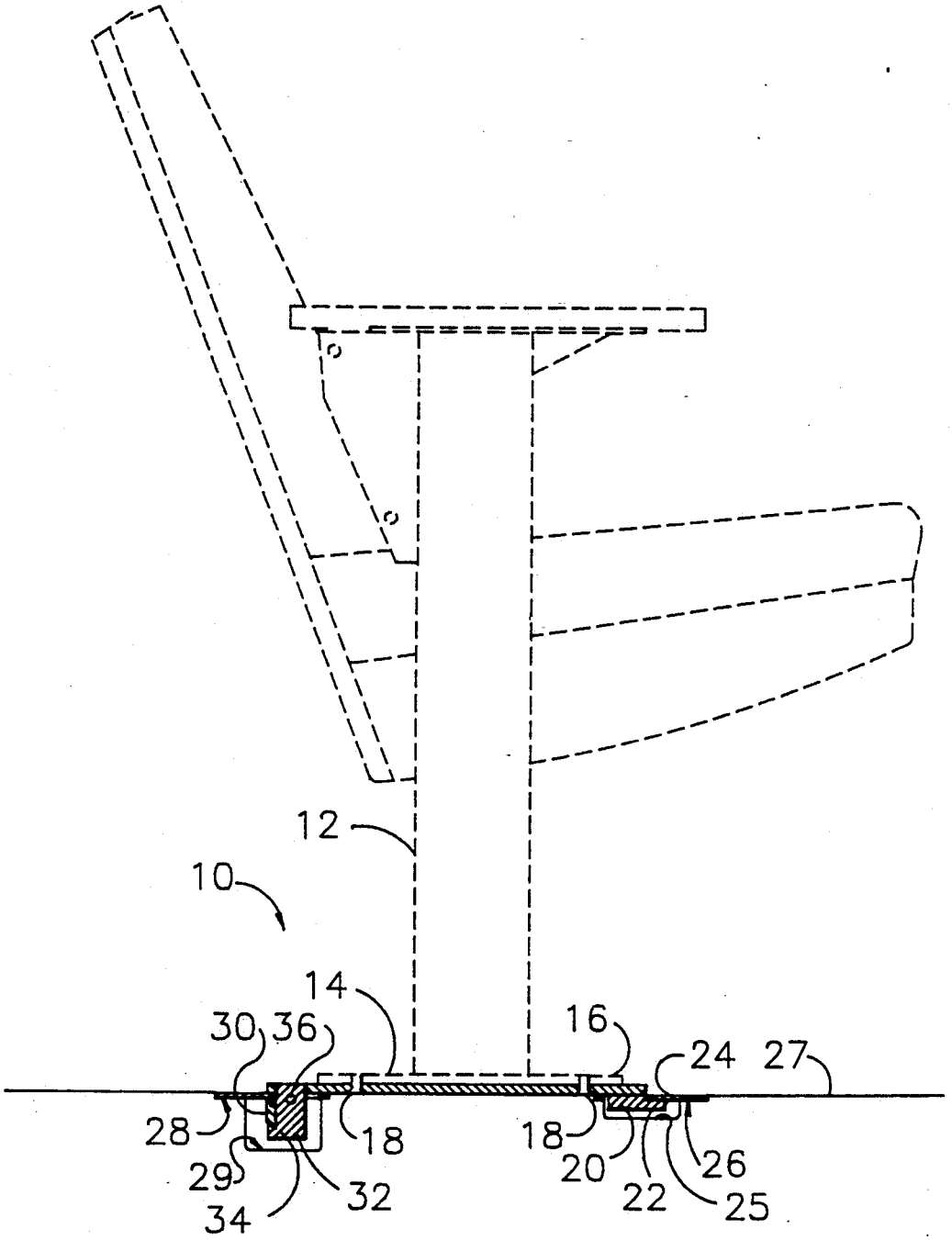
FIG. 1 is a side elevational view of a conventional theater chair to which the novel base plate has been attached.

Referring now to FIG. 1, it will there be seen that a theater chair equipped with the novel parts is denoted as a whole by the reference numeral 10.

Apparatus 10 includes a conventional chair post 12 which supports a theater chair, shown in phantom lines. Flat plate 14 supports post 12 and is also conventional. Said conventional flat plate 14 overlies novel base plate 16 and is fixedly secured thereto by suitable fastening means such as screw members 18.

A patron seated atop the chair would be facing to the right side of the drawing; thus, that side of the apparatus will be referred to as the front or leading side and the other side thereof will be referred to as the rear or trailing side.

A pair of laterally spaced apart ear members 20, only one of which can be seen in FIG. 1, is fixedly secured to the leading edge of base plate 16. A forwardly projecting part 22 thereof underlies and abuttingly engages a horizontal wall 24 that forms a part of the front cover plate 26 that receives ear 20 and which covers hole 25 formed in the concrete floor of the theater. This arrangement of parts holds down the leading edge of base plate 16. The floor of the theater is denoted 27.

Rear cover plate 28, of which there are two, covers hole 29. Rear cover plate 28 includes a depending wall 30 that is engaged in the manner shown by its associated rear foot anchor 32. More particularly, each rear foot anchor includes a ledge 34 formed in its trailing edge, and said ledge abuttingly engages its associated depending wall 30 as shown.

It should be gleaned from 1 FIG. that the depicted interlocking of the rear foot anchors 32 with their associated depending walls 30, coupled with the interlocking of the ears 20 with walls 24, prevents facile removal of the theater chair from its mount, thereby accomplishing an important object of this invention. It should therefore be understood that the rear foot anchors, the ear members, the cover plates, and the base plate collectively make up the novel attachment means for removeably mounting a chair to a floor. In some of the claims that follow, the rear foot anchors may be referred to simply as pivotally mounted means.

Reference numeral 36 in FIG. 1 represents an armature about which each rear foot anchor 32 is pivotally mounted. A flat steel spring 38 (FIGS. 4 and 5*a*) is employed to maintain each rear foot anchor in the position depicted in FIG. 1. It should therefore be understood that a rearward pivoting of each rear foot anchor 32 about the pivot point defined by armature 36 will disengage ledge 34 from depending wall 30 and thereby enable the removal of the chair from its mount. The novel tool, hereinafter disclosed, performs the required pivoting.

Figure 2:
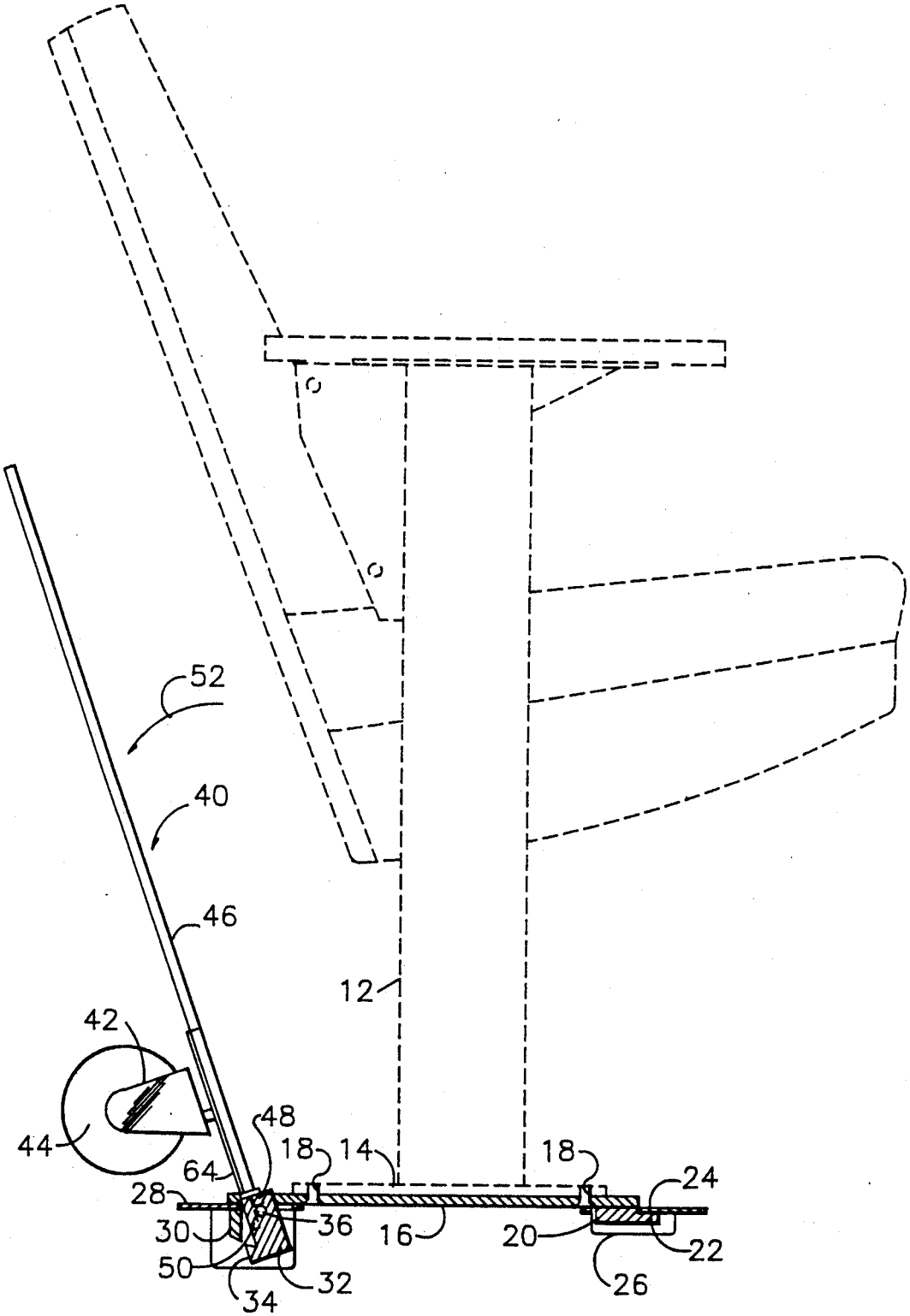
FIG. 2 is a view like that of FIG. 1, but including as well a side elevational view of the novel tool and showing the released position of the rear foot anchors.

Reference should now be made to FIG. 2, where said novel tool is shown in side elevation and denoted 40 as a whole. A clevis 42 rotatably mounts wheel 44 to the trailing side of the tool to enable the chair to be carted away after the pivoting of the rear foot anchors 32 has been achieved. Tool 40 includes a pair of laterally spaced rails 46, only one of which may be seen in FIG. 2 due to the side elevation. A first, truncate rod 48 is secured by suitable means to the lowermost end of each rail and a second, more elongate rod 50 is similarly attached to said lowermost end, just rearwardly of the truncate rod 48. As shown in FIG. 2, truncate rod 48 rests atop armature 36 when elongate rod 50 is slidingly inserted between armature 36 and depending wall 30 of the rear cover plate 28. This provides a mechanical advantage when the tool 40 is rocked rearwardly as indicated by the directional arrow 52. Due to the length of each rail 46, the strength required to separate each rear foot anchor 32 from its associated depending wall 30 is nominal as should be clear by comparing FIGS. 1 and 2.

It is believed that those skilled in the mechanical arts could make and use the novel apparatus, and many differing embodiments thereof, from the above description when taken in connection with FIGS. 1 and 2, and that the remaining figures need not be disclosed or described. However, to facilitate the making and using of this particular embodiment of the invention, FIGS. 3–11 are provided and are described as follows. FIGS. 12–52 will then disclose further embodiments.

Figure 3:
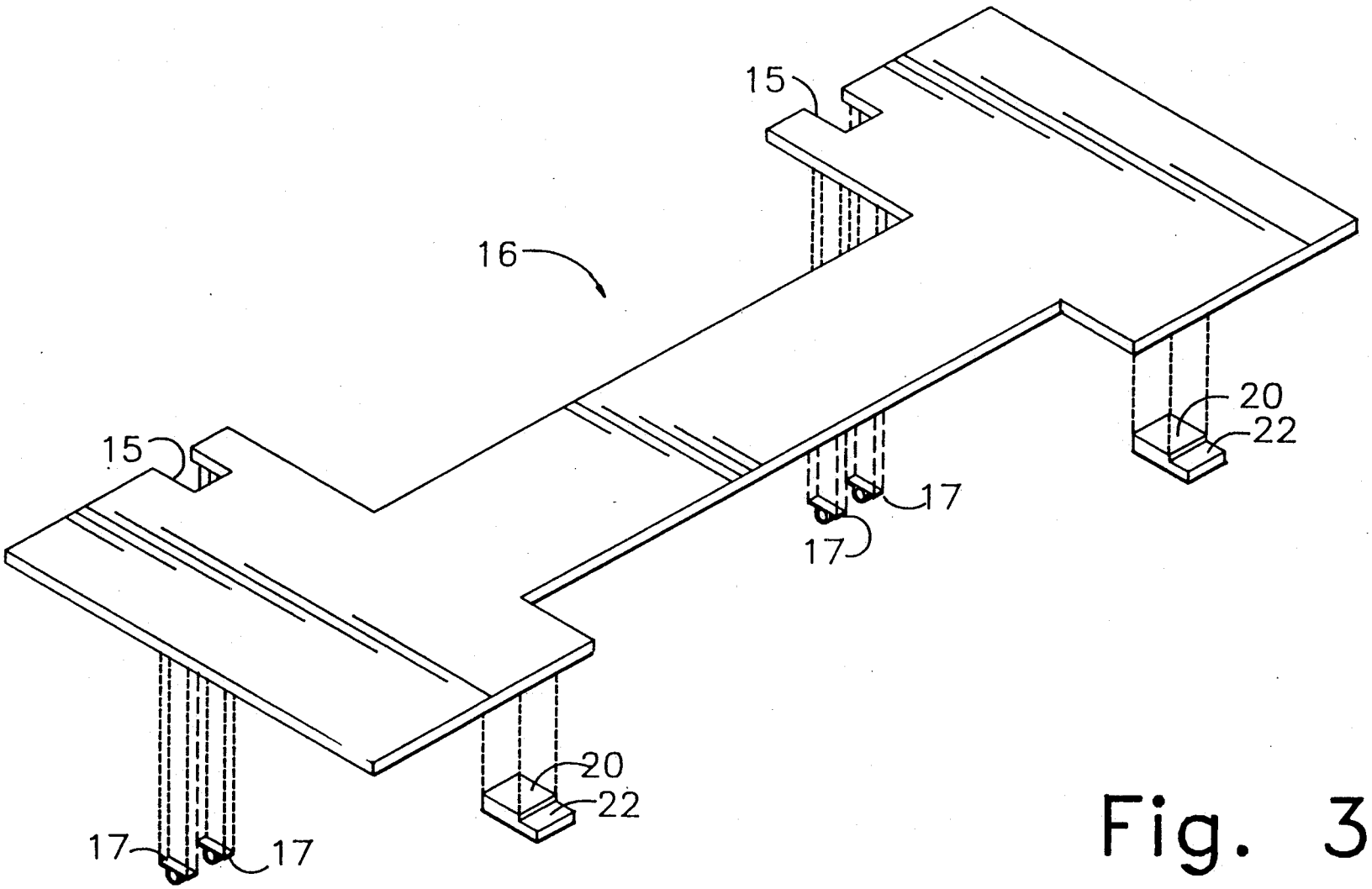
FIG. 3 is an isometric exploded view of the novel base plate.

FIG. 3 shows that an illustrative embodiment of flat base plate 16 is configured as shown. A pair of cut away notches, collectively denoted 15, are formed in the trailing edge thereof to accommodate their associated rear foot anchors 32. The opposite ends of armatures 36 are pivotally mounted within mounting members 17 which flank each notch 15 when the base plate 16 is assembled as indicated by the dotted lines. Ear members 20 and their attachment to the underside of the leading end of the base plate have been previously described.

Figure 4:
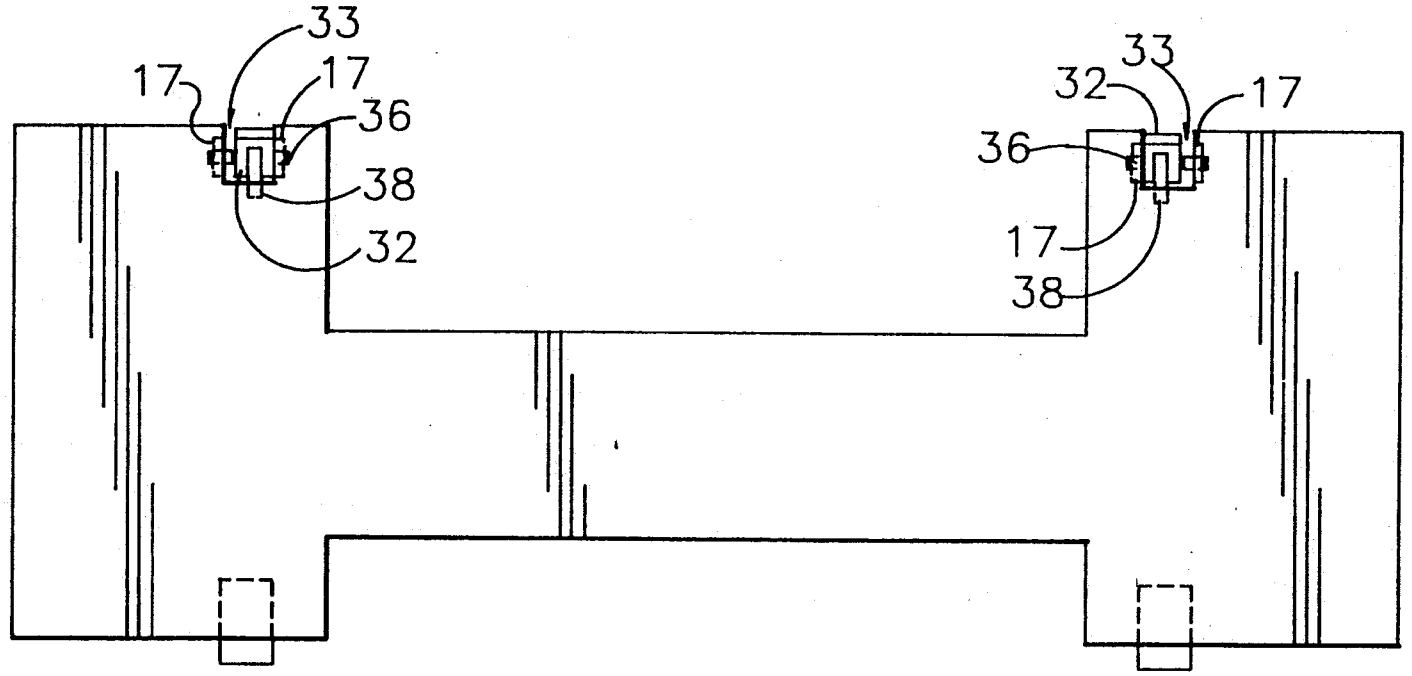
FIG. 4 is a top plan view of said base plate with the ear members fixedly secured to the leading edge thereof and the rear foot anchors pivotally secured to the trailing edge thereof.

The assembled base plate is depicted in FIG. 4. Note how each rear foot anchor 32 is spaced as at 33 from an outer edge of each notch 15; this space 33 receives the elongate rod 50 that was shown and described in connection with FIG. 2.

Figure 5:
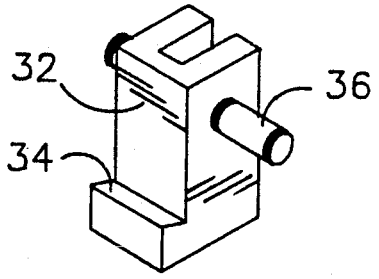
FIG. 5 is an isometric view of a rear foot anchor taken from the trailing side thereof.

An isometric view of this first embodiment of the rear foot anchor 32 is provided in FIG. 5; it is shown pivotally mounted on its associated armature 36.

Figure 5A:
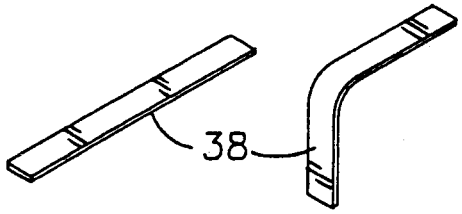
FIG. 5*a* is a compound view of a flat steel spring employed to bias each rear foot anchor.

The bent and unbent configurations of the flat steel spring 38 are shown in FIG. 5A.

Figure 6:
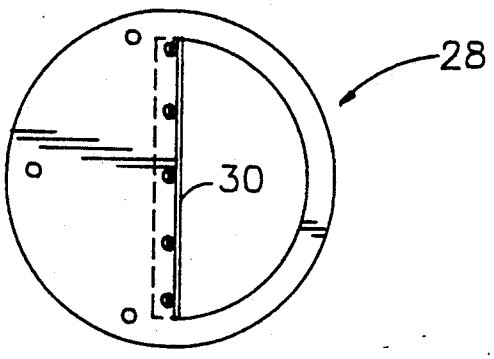
FIG. 6 is a top plan view of a rear cover plate or catch.

Rear cover plate 28 appears in plan view in FIG. 6; note the semicircular cut away formed therein to produce depending wall 30.

Figure 7:
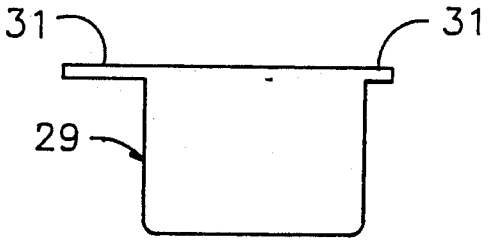
FIG. 7 is a side elevational view of the shape of the hole that is formed in the theater floor to accommodate said rear cover plate, said hole being covered by its associated rear cover plate.
Figure 10:
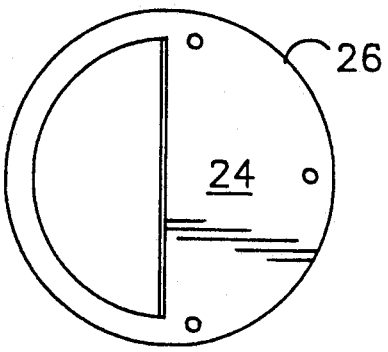
FIG. 10 is a top plan view of a front cover plate.

The hole formed in the theater floor to accommodate its associated rear cover plate is denoted 29 in FIG. 7. Rear cover plate 28 will lie flush with the floor of the theater when it is inserted into hole 29, i.e., the depth of the parts of the hole labeled 31 is equal to the thickness of the rear floor cover plate 28, exclusive of depending wall 30.

Figure 8:
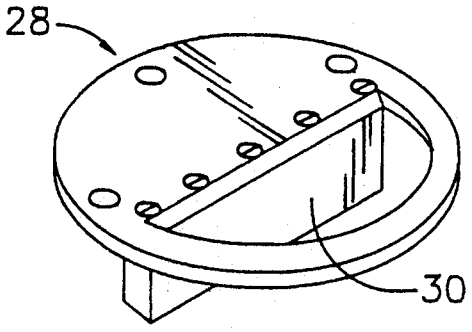
FIG. 8 is an isometric view of said rear cover plate.

FIG. 8 shows a rear cover plate 28 in isometric view.

Figure 9:
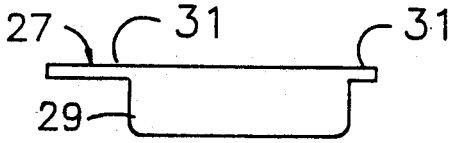
FIG. 9 is a side elevational view of the shape of the hole that is covered by its associated front cover plate.

FIG. 9 shows the hole 27 that accommodates its associated front cover plate. The depth of the shallow parts 31 of hole 27 is equal to the thickness of the parts of the front floor cover plate 26 received therewithin so that said front cover plate lies flush with the floor of the theater. A plan view of a front cover plate 26 appears in FIG. 10.

Figure 11:
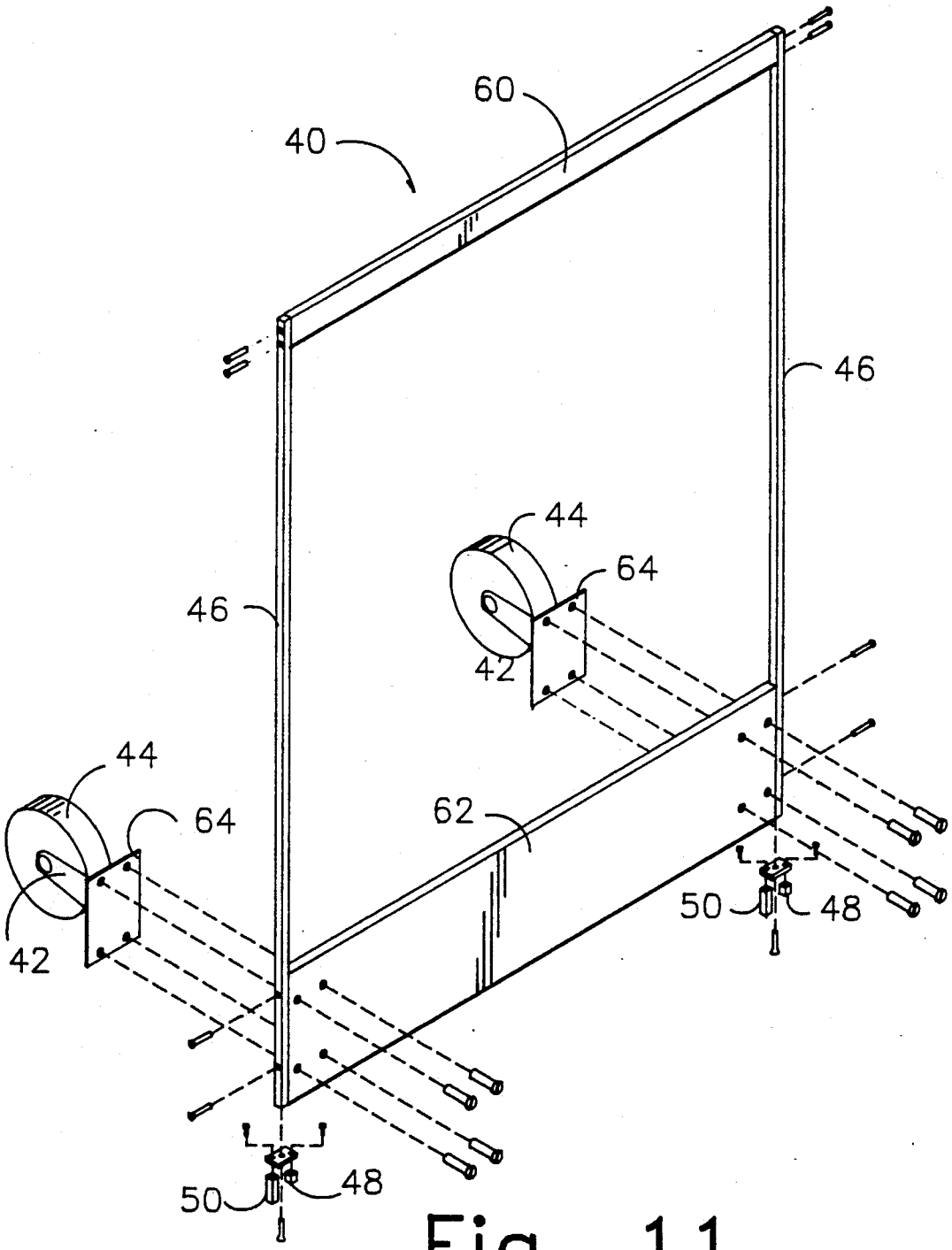
FIG. 11 is an isometric exploded view of a first embodiment of the novel tool.
Figure 12:
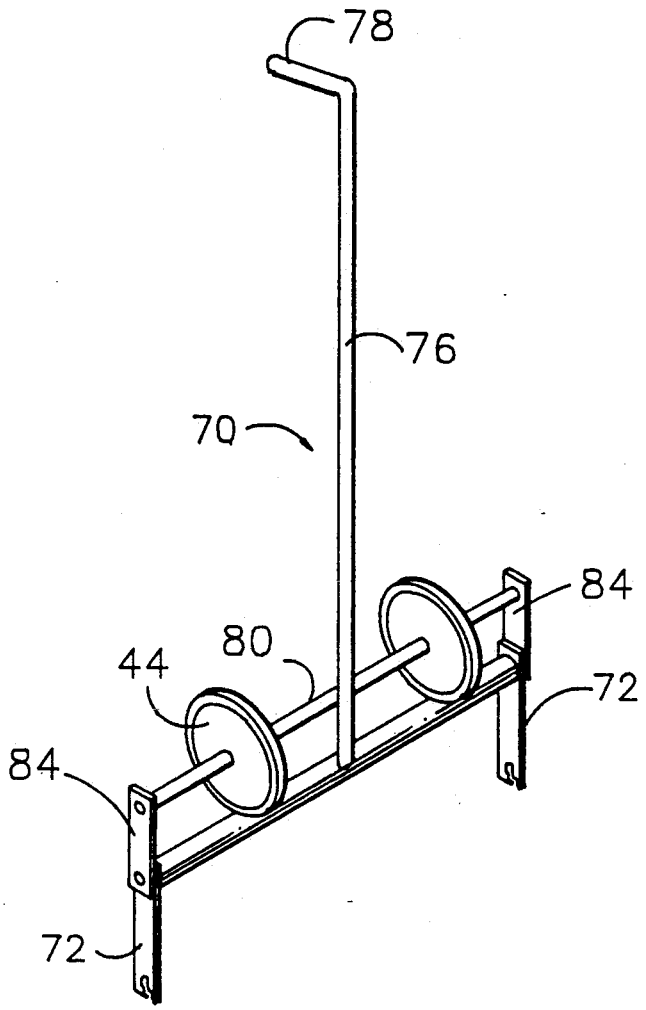
FIG. 12 is an isometric view of a second embodiment of the novel tool.
Figure 13:
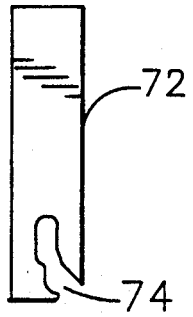
FIG. 13 is a side elevational view of the armature-engaging part of said tool.
Figure 12A:
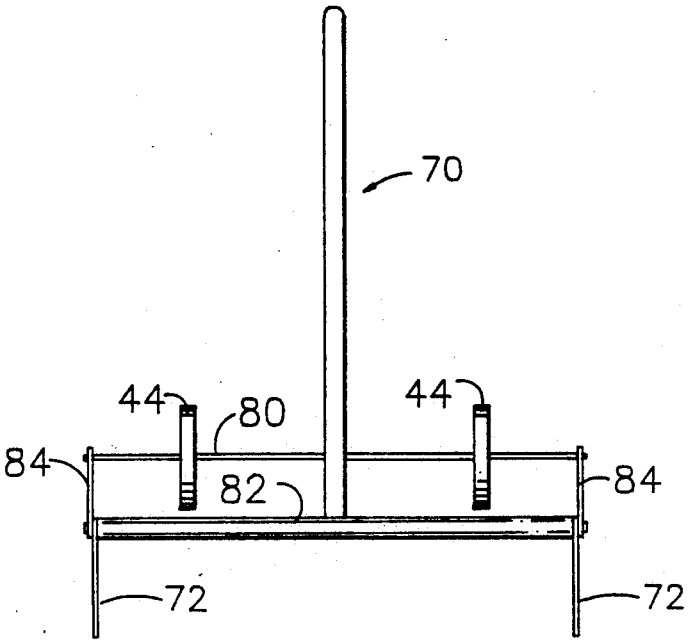
FIG. 12*a* is a front elevational view of said second embodiment.
Figure 12B:
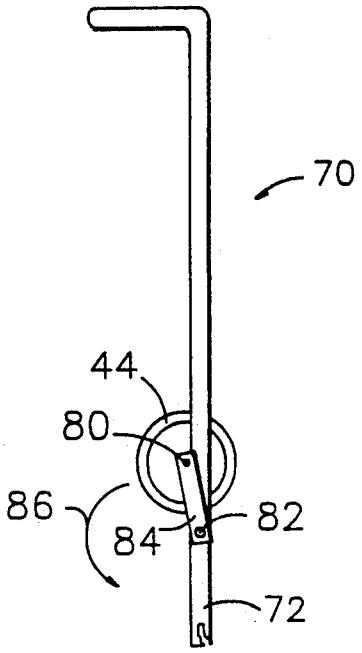
FIG. 12*b* is a side elevational view
Figure 12C:
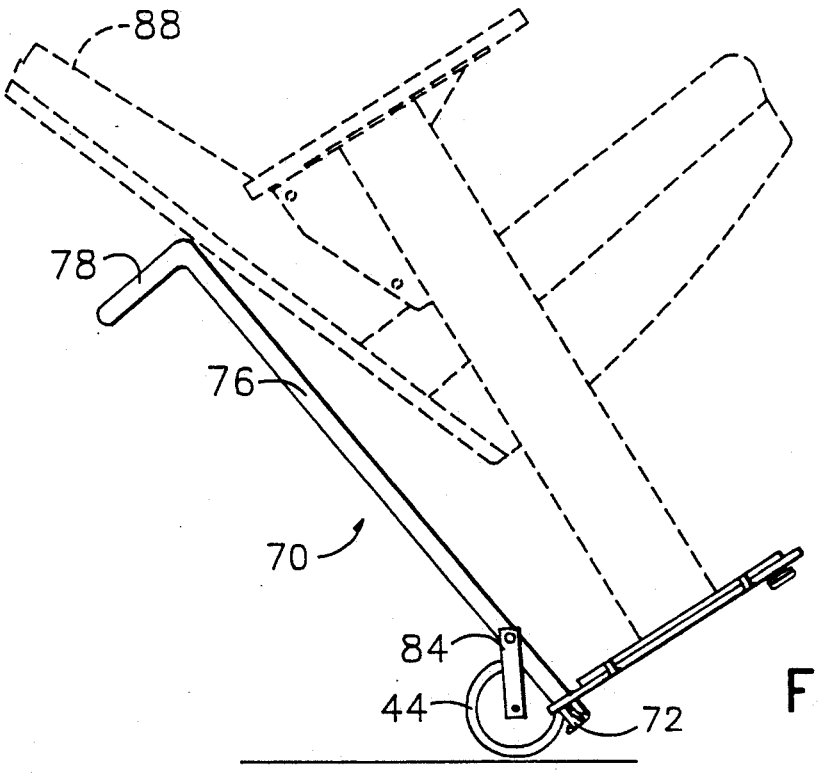
FIG. 12*c* is a side elevational view of said second embodiment when carting a chair.
Figure 14:
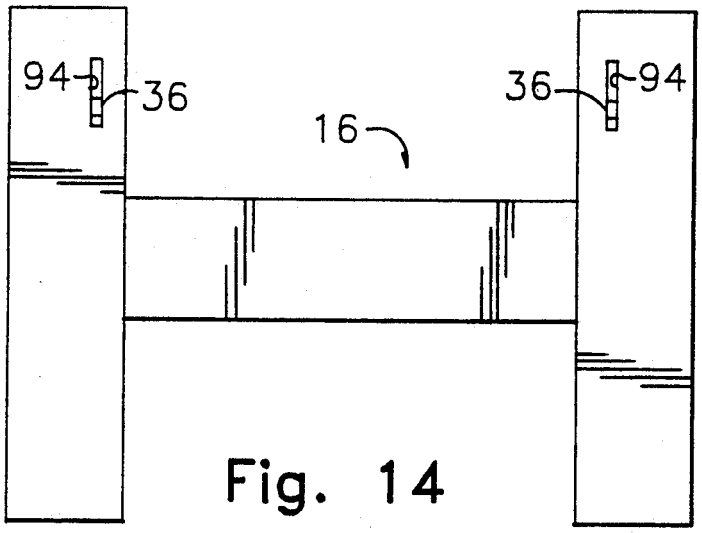
FIG. 14 is a top plan view of a second embodiment of the novel base plate.

Tool 40 is shown in increased detail in FIG. 11. It is there seen to include a laterally disposed handle 60 that interconnects rails 46 at their respective uppermost ends, and a laterally disposed support plate 62 that interconnects said rails at their lowermost ends. Wheel mounting plates 64 perform the function their name expresses.

A second embodiment of the tool is shown in FIGS. 12, 12*a*, 12*b*, and 12*c*; it is denoted 70 as a whole. It includes an armature-engaging means 72 that has a slot 74 formed therein for engaging a rear foot anchor armature similar to the armature 36 of the first-described embodiment.

Tool 70 includes handle 76 that is bent as at 78 to facilitate its use Part 76 non-rotatably receives a first axle 80 having wheel members 44 rotatably mounted thereon, and said part 76 has its lowermost end fixedly secured to a cross bar 82. Links 84 interconnect opposite ends of axle 80 and cross bar 82. As perhaps best understood in connection with FIGS. 12*b* and 12*c*, wheels 44 are rotated as indicated by directional arrow 86 in FIG. 12*b* into the position shown in FIG. 12*c* when tool 70 is used to cart a chair 88 away. Note that members 72 are not pivotally mounted.

Figure 15:
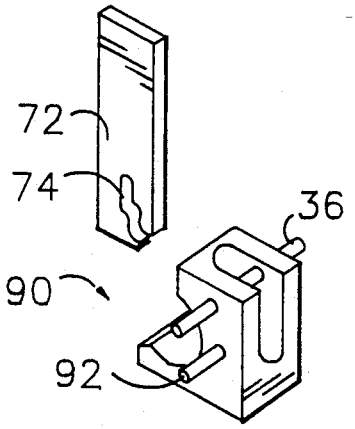
FIG. 15 exploded perspective view of a second embodiment of a rear foot anchor and said armature-engaging part.
Figure 16:
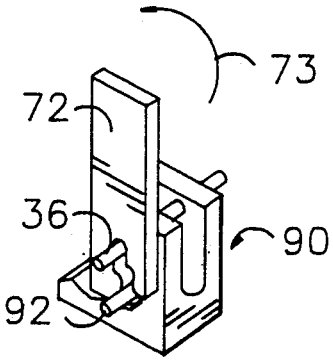
FIG. 16 is a perspective view of the parts in FIG. 15 in their assembled configuration.

A second embodiment of a rear foot anchor is shown in FIG. 15; it is denoted 90 as a whole. It includes armature 36 that is received within slot 74 as depicted in FIG. 16 when the tool 70 is being used to remove the chair or other secured object. It also includes a rod 92, spaced downwardly from said armature and disposed parallel thereto, that is received within the same slot; rod 92 provides the engagement means between armature-engaging member 72 and foot anchor 90 because armature 36 provides a pivot point only as is perhaps best understood in connection with Figs. 18 and 19, described hereinafter.

Figure 17:
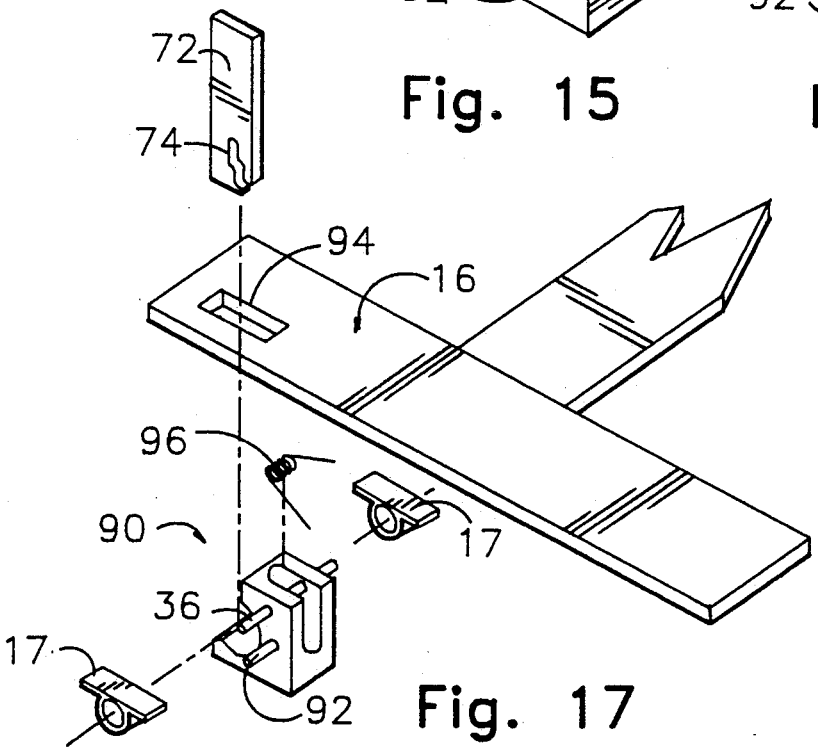
FIG. 17 an exploded perspective view showing how the armature-engaging part extends through an opening formed in the base plate to engage a rear foot anchor.

In this second embodiment of the invention, rectangular slots 94 are formed in the base plate 16 to accommodate their associated member 72 as best shown in FIG. 17. Note in FIG. 14 that armature 36 is accessible through said slots 94.

Figure 18:
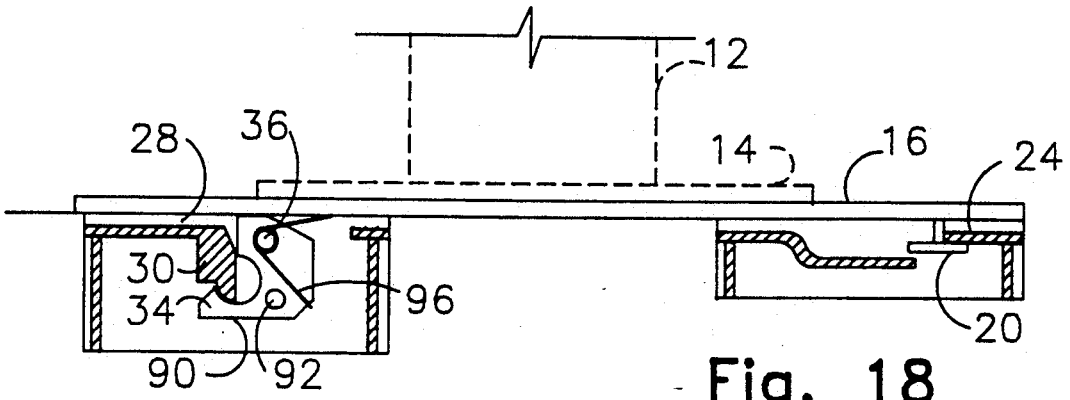
FIG. 18 is a sectional view showing the engagement of the base plate and the cover plates.
Figure 19:
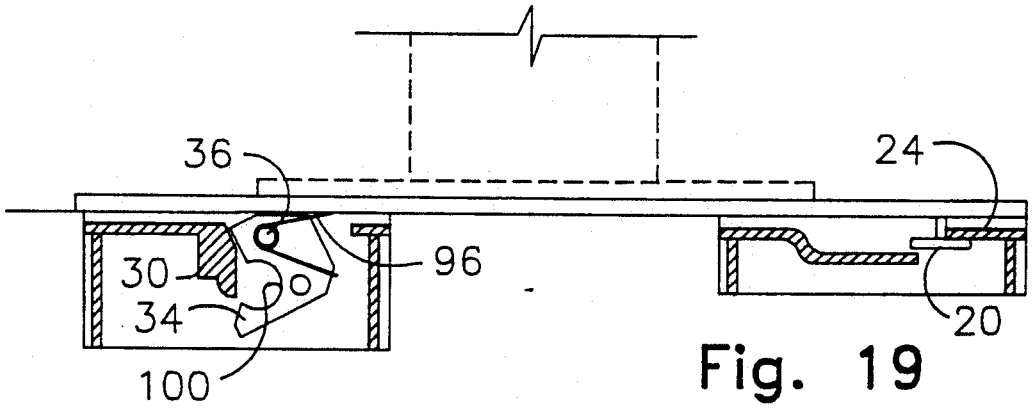
FIG. 19 is a sectional view showing a rear foot anchor disengaged from its rear cover plate.

The operation of this embodiment is best explained in connection with FIGS. 18–20. Depending wall 30 of rear cover plate 28 is engaged by rearwardly-extending ledge 34 of rear foot anchor 90 when the chair or other object is mounted to the floor; circular cut-away 100 formed in each rear foot anchor accommodates said depending wall 30. Note that rear cover plate 28, depending wall 30, and ledge 34 have a different construction in this embodiment than their first embodiment counterparts, but the same reference numerals are used to point them out because they perform similar functions. Torsion spring 96 or other suitable bias means holds its associated rear foot anchor 90 in its locked position as depicted in FIG. 18.

Special tool 70 is required to unlock said foot anchor 90; more specifically, each foot anchor 90 is engaged through its associated slot 94 by member 72 as best shown in FIG. 16. When the engagement of FIG. 16 is achieved, the rear foot anchor 90 remains in its FIG. 18 position. Tool 70 is then rocked rearwardly by its user, placing torsion spring 96 under torsion, and part 72 pivots rearwardly as indicated by directional arrow 73 in FIG. 16; armature 36 serves as the pivot point for this pivotal motion. The pivoted position of the foot anchor 90 is shown in FIGS. 19 and 20. Note in FIG. 19 that ledge 34 has cleared depending wall 30 so that foot anchor 90 may be lifted from its hole without interference from cover plate 28 as shown in FIG. 20. Note also in FIG. 20 that the leading end of the base plate 16 can then be slid rearwardly to disengage it from the front cover plates.

Figure 21:
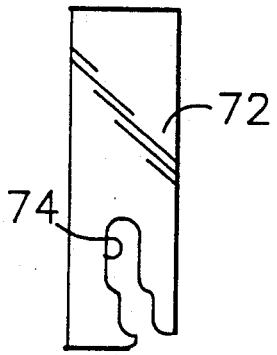
FIG. 21 is a side elevational view of the armature-engaging member.

FIG. 21 shows the specific configuration of slot 74; the upper part of said slot that receives armature 36 is spaced a little rearwardly of the lower part thereof that receives rod 92, to correspond with the relative positions of armature 36 and rod 92 with respect to one another.

Figure 22:
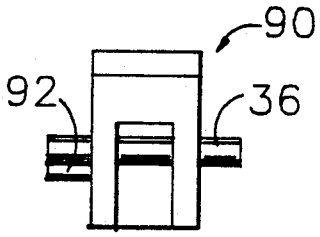
FIG. 22 is a top plan view of a rear foot anchor.
Figure 23:
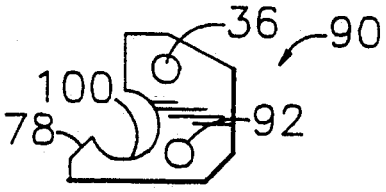
FIG. 23 is a side elevational view of a rear foot anchor.
Figure 24:
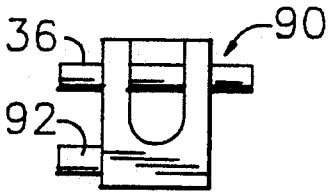
FIG. 24 is a front elevational view of a rear foot anchor.

FIGS. 22–24 provide detailed views of the structure of rear foot anchor 90.

Figure 20:
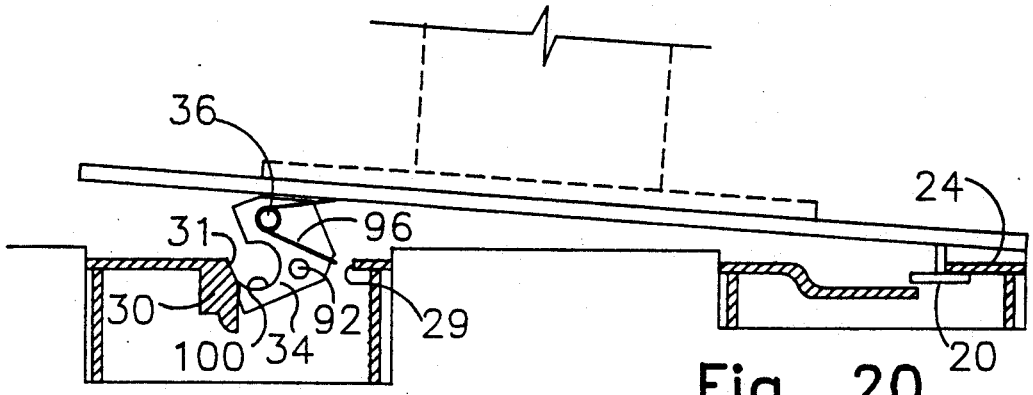
FIG. 20 is a sectional view showing the trailing edge of the base plate being lifted from the floor so that the leading edge of the base plate can be separated from the front cover plates.
Figure 25:
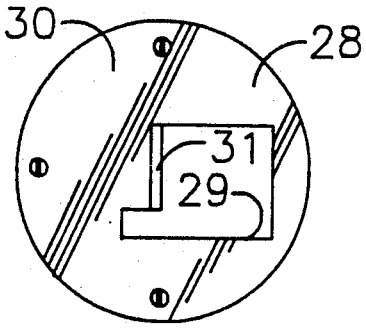
FIG. 25 is a top plan view of a rear cover plate.
Figure 26:
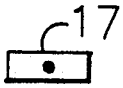
FIG. 26 is a top plan view of a mounting member that is attached to an underside of the base plate and which receives a rear foot anchor armature.
Figure 27:
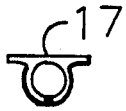
FIG. 27 is a side elevational view of said mounting member.
Figure 28:
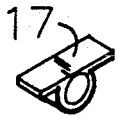
FIG. 28 is a perspective view thereof.
Figure 29:
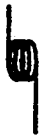
FIG. 29 is a top plan view of a torsion spring.
Figure 30:
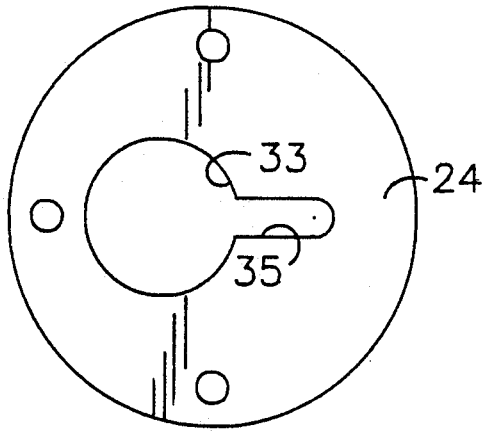
FIG. 30 is a top plan view of a second embodiment of a front cover plate.
Figure 31:
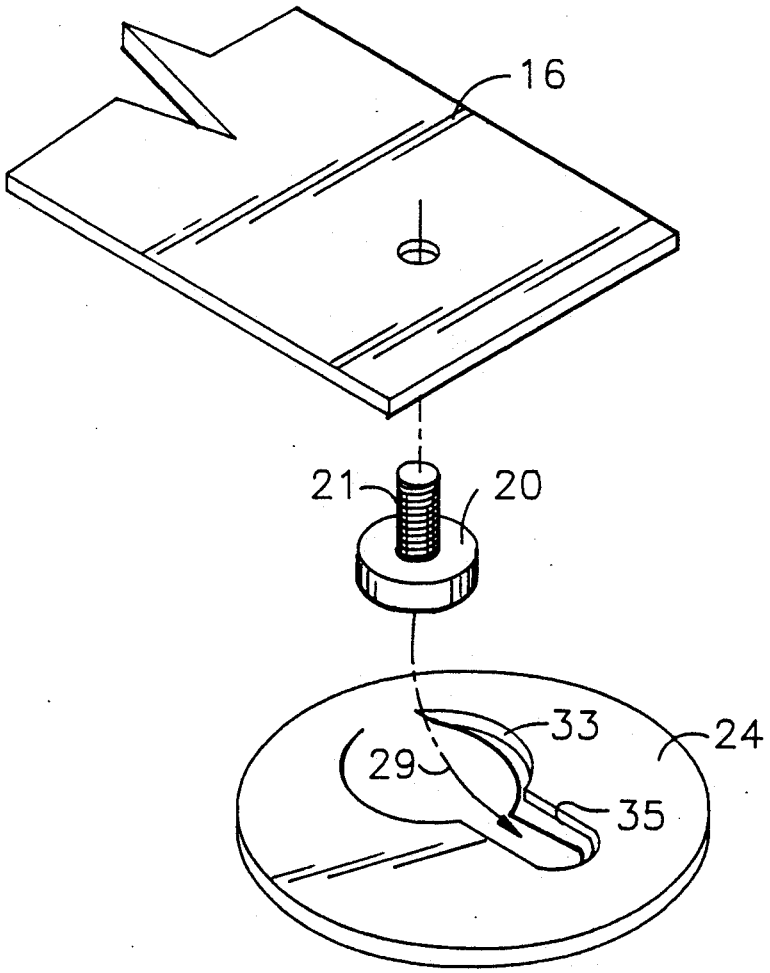
FIG. 31 is an exploded perspective view showing how the leading edge of the base plate is secured to a front cover plate.

The second embodiment of the rear cover plate 28 is shown in plan view in FIG. 25; opening 29 formed therein accommodates member 72 and also enables foot anchor 90 to pass therethrough as shown in FIG. 20. Beveled surface 31 formed in depending wall 30 (FIG. 20) is also pointed out in FIG. 25 to more fully disclose the structure of the rear cover plates 28 of this second embodiment.

Torsion spring 96 is shown in FIG. 29 and FIGS. 26–28 show the mounting members 17 that are common to the first and second embodiments.

The front cover plates 24 of this second embodiment and the ears 22 that engage them are numbered identically with their first embodiment counterparts, but the different construction of said parts should be noted. These parts are shown in better detail in FIGS. 30 and 31. Opening 33 in front cover plate 24 accommodates the head 20 of a screw member that screw threadedly engages base plate 16, and the narrow part 35 of that opening accommodates the threaded shank 21 of the screw member when part 20 is slid forwardly as indicated by directional arrow 29 in FIG. 31. The breadth of slot 27 is less than the diameter of head 20; thus, the leading edge of base plate 16 is efficiently held down, and said leading edge cannot be released until the rear foot anchors have been pivoted to release the trailing edge of the base plate.

Four additional alternate embodiments of the rear foot anchors will now be described. In each of these four final embodiments, the front foot anchors is unchanged.

Figure 32:
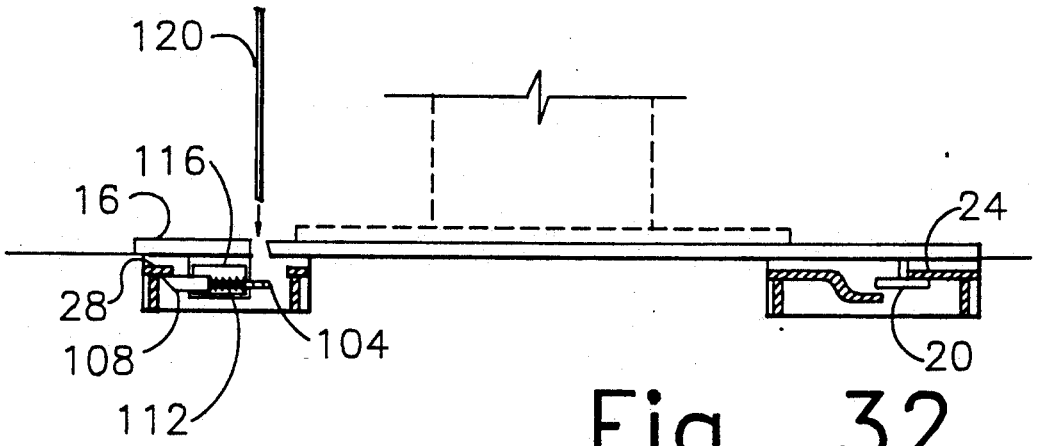
FIG. 32 is a sectional view of an alternate embodiment showing a rear foot anchor in the form of a spring-loaded latch means.
Figure 33:
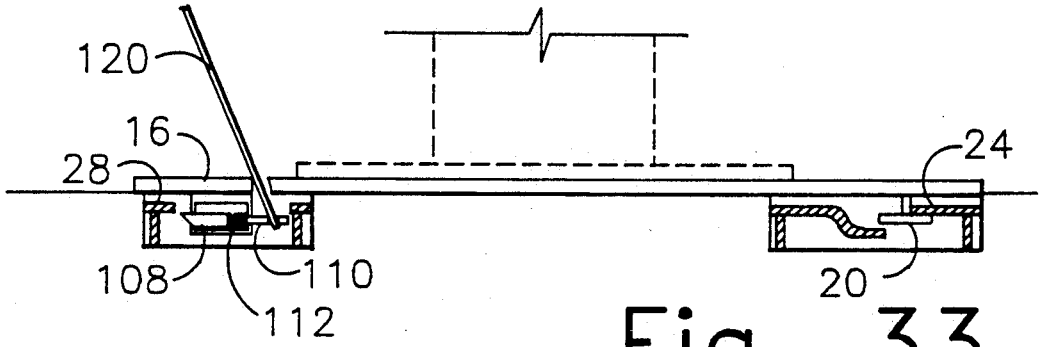
FIG. 33 is a sectional view showing a tool being used to slide the latch means out of engagement with its associated rear cover plate.
Figure 34:
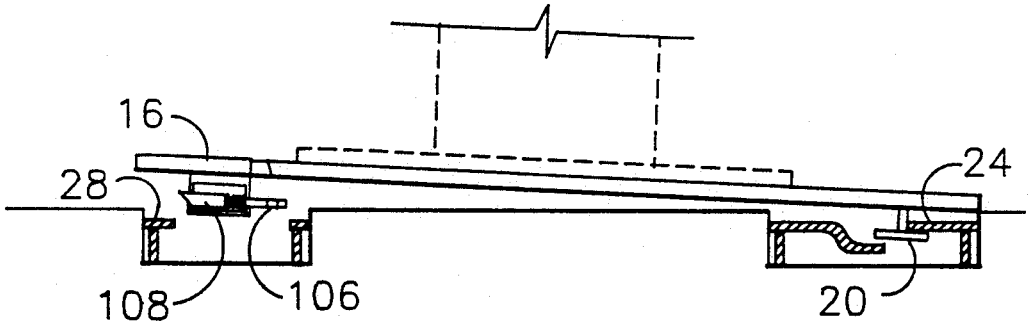
FIG. 34 is a sectional view showing the trailing end of the base plate being lifted from the floor.
Figure 35:
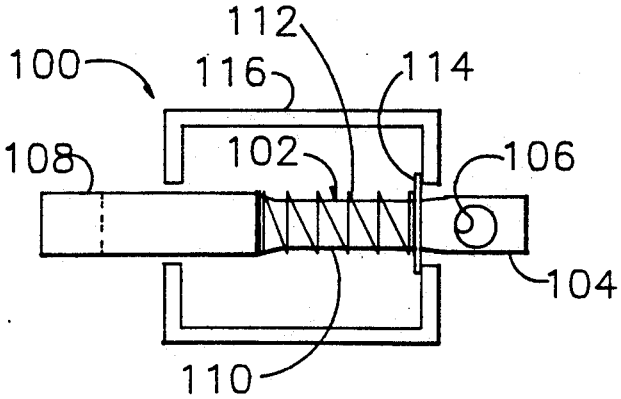
FIG. 35 is a top plan view of the spring-loaded latch means of this embodiment.
Figure 36:
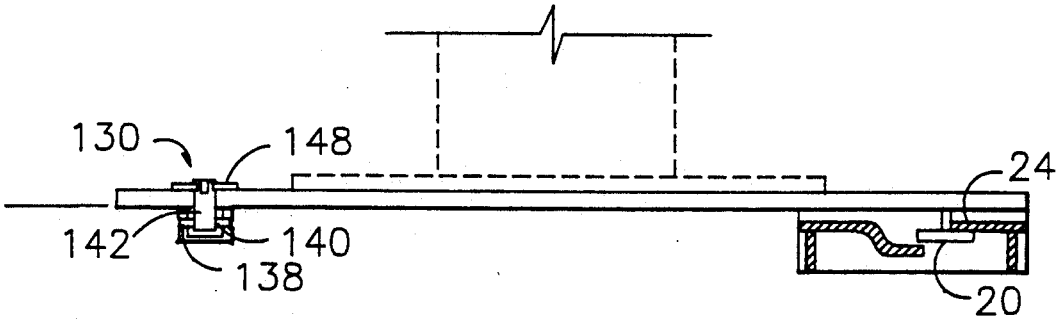
FIG. 36 is a side elevational view showing another alternative embodiment of a rear foot anchor engaged to its associated cover plate.
Figure 37:
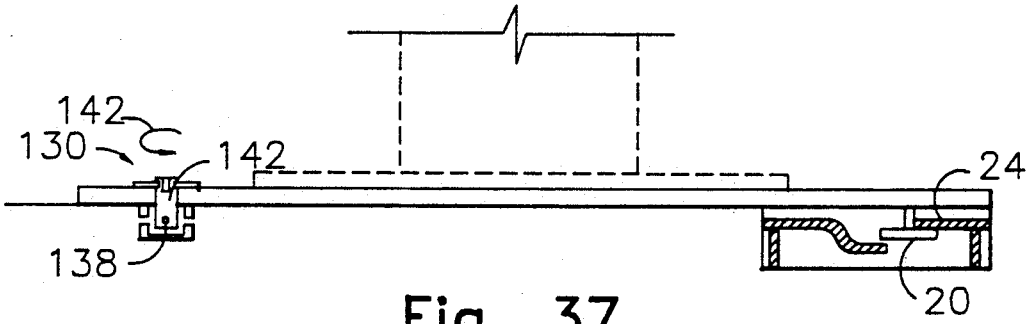
FIG. 37 is a side elevational view showing how a rotational motion unlocks the trailing edge of the base plate from its rear foot anchor in this embodiment.

FIG. 35 shows a rear foot anchor 100 in the form of a spring-loaded pin 102. Pin 102 has a leading end 104 having a central aperture 106 formed therein and a trailing end 108. The medial part 110 of the pin has a reduced diameter relative to the diameter of the ends 104 and 108; spring 112 axially receives said medial part. The trailing end of the spring is retained by the increased diameter of the trailing end 108 of the pin and the leading end of the spring is retained by a washer 114 that in turn abuts housing 116. Thus, when the spring 112 is in repose, the trailing end 108 of the spring is fully extended rearwardly of housing 116, as depicted in FIG. 35 and in FIG. 32. As shown in FIG. 32, trailing end 108 engages the underside of rear cover plate 28 when the spring is in said position of repose. Thus, the trailing end of base plate 16 cannot be lifted upwardly from said rear foot anchor 100. A linear-in-configuration tool 120 is inserted through an opening formed in base plate 16 and in cover plate 28 so that the leading end of said tool may enter aperture 106 as depicted in FIG. 33. Rocking the tool 120 rearwardly as depicted in FIG. 33 loads spring 112, thereby compressing it and causing the retraction of trailing end 108 until it disengages from rear cover plate 28 as depicted in FIGS. 33 and 34. This releases the base plate 16 from foot anchors 100. Note that tool 100 includes two laterally spaced linear-in-configuration members 120, only one of which is shown due to the side elevational depiction thereof. Tool 120 has a construction similar to the tool shown in FIG. 11.

Figures 38, 39, 40:
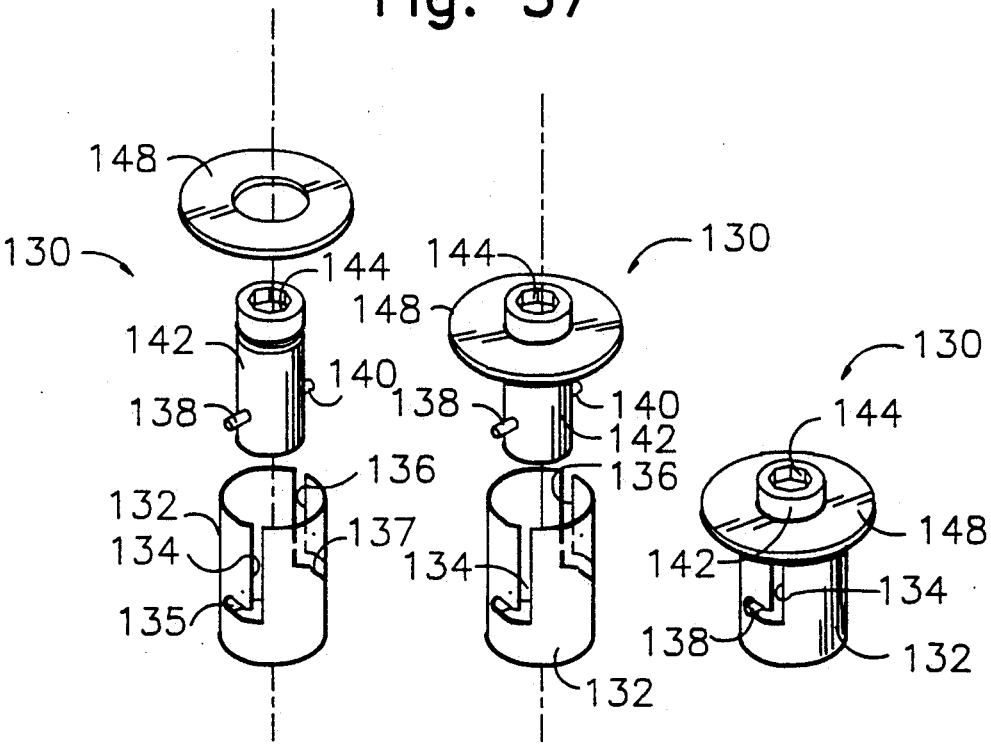
FIG. 38 is an exploded perspective view of the rear foot anchor of this embodiment.
FIG. 39 is an exploded, partially assembled view of the parts shown in FIG. 38.
FIG. 40 is a perspective, fully assembled view of the parts shown in FIGS. 38 and 39.

FIGS. 36–40 show a rear foot anchor 130 including a cylindrical base 132 that has a pair of diametrically opposed "L"-shaped slots formed therein. These slots receive arms 138, 140, respectively, that extend laterally from a tubular insert 142 that is slideably received within base 132. Arms 138, 140, are aligned with their associated slots 134, 136, as depicted in FIGS. 38 and 39, and insert member 142 is then inserted into base 132. When the arms reach the bottom of their associated slots, insert 142 is rotated so that said arms enter into the circumferentially extending parts 135, 137 of the slots, as shown in FIG. 40. This prevents retraction of insert 142 from base 132 as perhaps best understood in connection with FIGS. 40 and 36. Insert 142 is internally bored, and said internal bore has a hexagonal or other engageable shape so that a tool fit within said bore may effect rotation of the insert when the tool is rotated. More particularly, a linear-in-configuration tool having a leading end that is keyed to the configuration of the internal bore 144 of the insert is inserted into said bore 144 and rotated as indicated by the directional arrow 146 in FIG. 37 to disengage arms 138, 140 from said circumferentially extending slots 135, 137 so that insert 142 may be retracted from base 132, as best understood by comparing FIGS. 36 and 37. Note that washer 148 overlies base plate 16.

Figure 41:
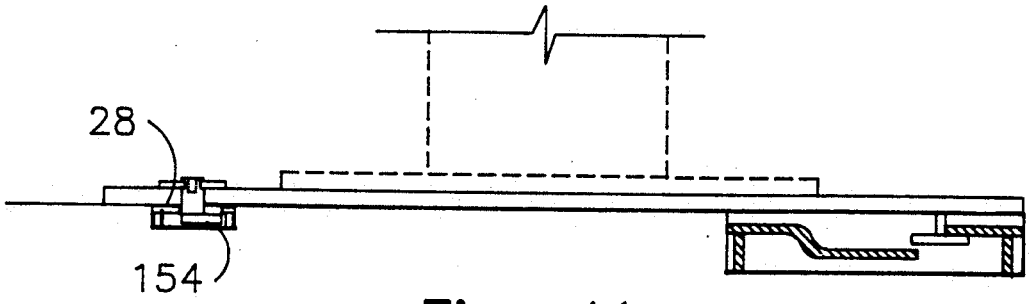
FIG. 41 is a side elevational view of another alternative embodiment of a rear foot anchor in its unlocked position.
Figure 42:
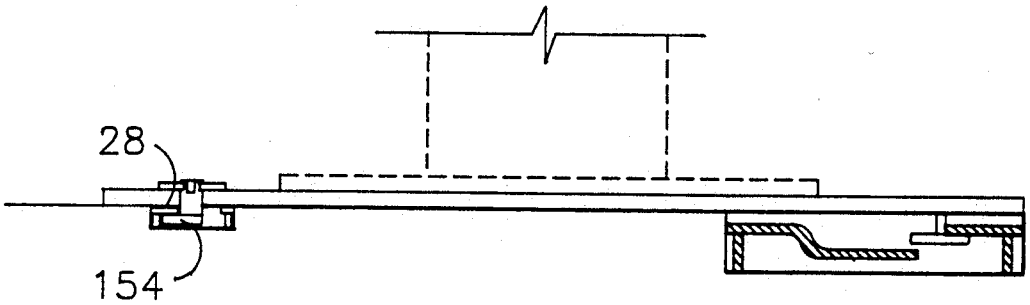
FIG. 42 is a side elevational view of said rear foot anchor in its locked position.
Figure 43:
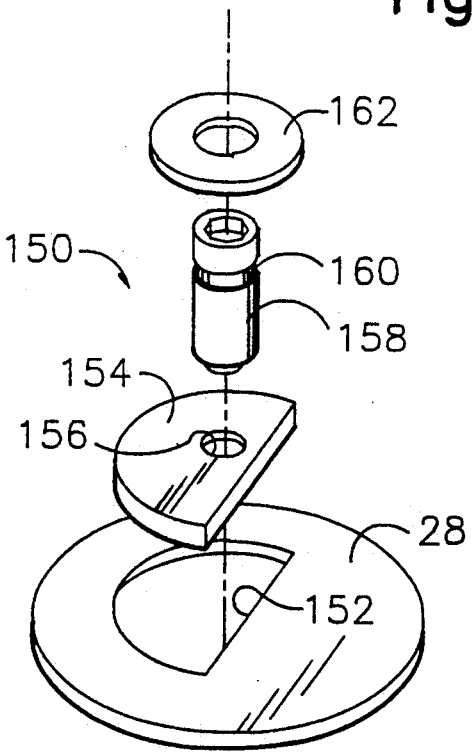
FIG. 43 is an exploded perspective view of the parts of this embodiment of the rear foot anchor and the embodiment of the rear cover plate with which it is used.
Figure 44:
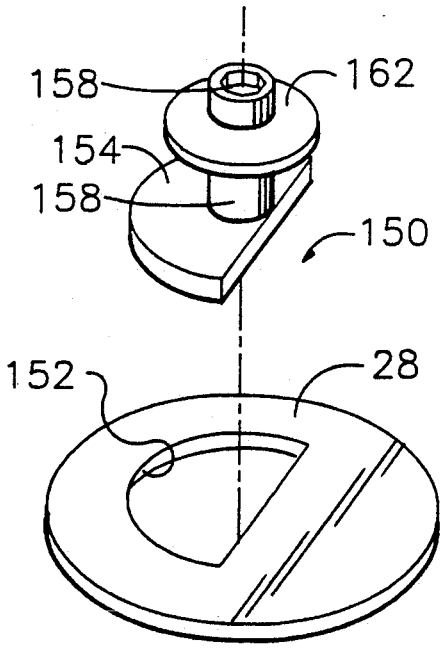
FIG. 44 is a perspective view of the rear foot anchor of this embodiment in its assembled configuration.
Figure 47:
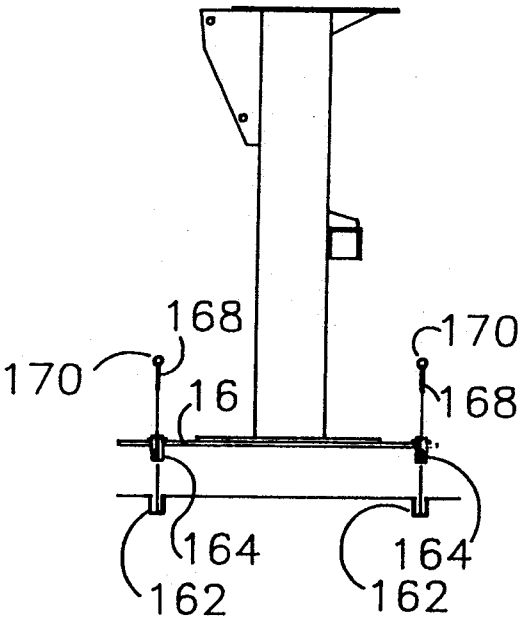
FIG. 47 is a side elevational view showing the base plate lifted from the floor.
Figure 46:
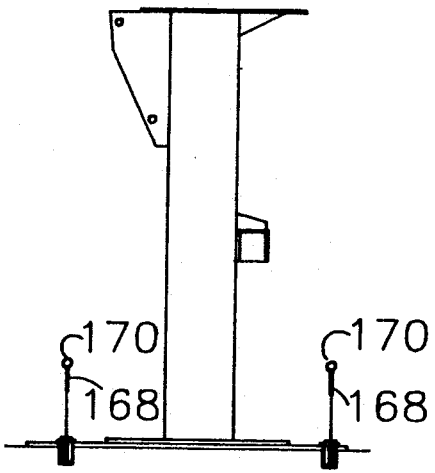
FIG. 46 is a side elevational view showing the foot anchors in their disassembled configuration.
Figure 45:
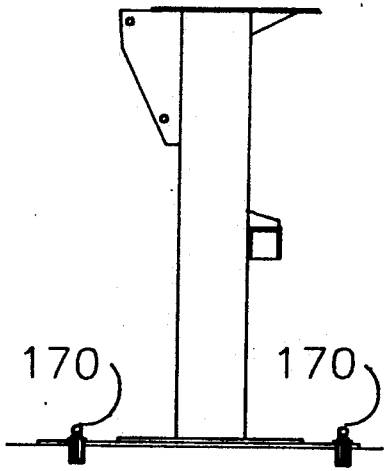
FIG. 45 is a side elevational view showing still another embodiment of the foot anchors, both front and rear, in their assembled configuration.

The embodiment of FIGS. 41–44 includes a flat rear cover plate 28, i.e., said cover plate includes no depending wall 30. A semicircular opening 152 is formed in said flat plate and said opening receives a semicircular detent member 154 therethrough as depicted in FIG. 41. Note in FIG. 41 that detent member 154 and opening 152 are in alignment; this position allows lifting of base plate 16. In FIG. 42, however, the detent 154 has been rotated one hundred eighty degrees so that detent 154 underlies rear cover plate 28, thereby preventing lifting of said base plate 16. Detent 154 is carried by tubular member 158 that has an annular recess 160 for mounting of washer 162; although not shown, tubular member 158 also has a hexagonal, or other convenient cross section, bore formed therein as in part 142 of the preceding embodiment and a tool of mating configuration is employed to turn the assembly from its FIG. 41 position to its FIG. 42 position and vice versa.

Figure 48:
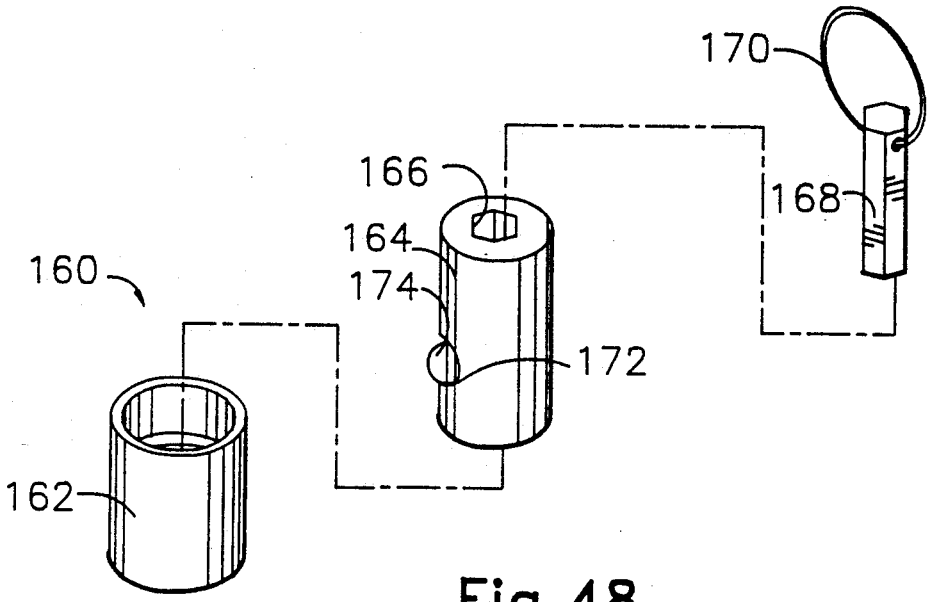
FIG. 48 is an exploded perspective assembly view of the final embodiment of the front and rear foot anchors.
Figures 49, 50, 51, 52:
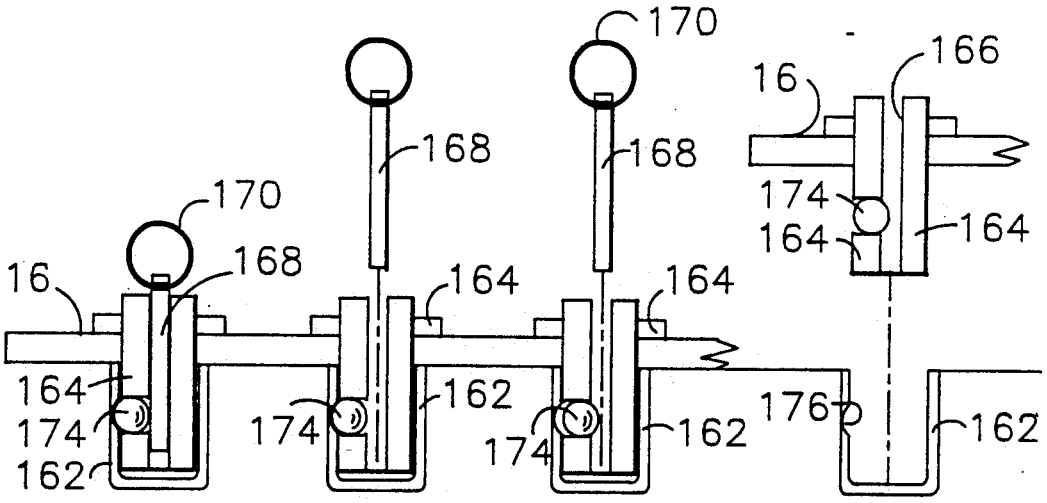
FIG. 49 is a side elevational view of a fully assembled foot anchor.
FIG. 50 is a side elevational view showing said foot anchor in a first disassembled configuration.
FIG. 51 is a side elevational view of said foot anchor in a second disassembled configuration.
FIG. 52 is a side elevational view showing the base plate separated from the floor as a result of disassembling said foot anchor.

The last embodiment of the rear foot anchors is shown in FIGS. 45–52; it is denoted 160 as a whole in FIG. 48 where it is shown in exploded form. Rear foot anchor 160 includes a cylindrical base member 162, a tubular insert member 164 having a hexagonal or other suitable keyway 166 formed therein, and a mating key 168 having a holding ring 170 that extends therethrough. A bore 172 is formed in a sidewall of insert 164 and a spherical ball 174 is received within said bore. A depression 176 (FIG. 52) is formed in a side wall of base 162 and ball 174 is forced into said depression when key 168 is positioned in keyway 166 of insert 164, as shown in FIG. 49. Thus, insert 164 cannot be retracted from base 162 and base plate 16 can not be lifted. However, when key 168 is removed as shown in FIGS. 50 and 51, ball 174 will dislodge from depression 176 and insert 164 may be withdrawn from base 162, thereby freeing base plate 16 as should be understood in connection with FIG. 47; note that insert 164 is fixedly secured to said base plate 16.

This invention is clearly new and useful. Moreover, it was not obvious to those of ordinary skill in this art at the time it was made, in view of the prior art when considered as a whole in accordance with the requirements of law.

It will thus be seen that the objects set forth above, and those made apparent by the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims ar intended to cover all of the generic and specific features of the invention herein described, and all statements of the scope of the invention that might be said, as a matter of language, to fall therebetween.

What is claimed is:

1. An object that is removably mounted to a floor, comprising:

a flat base plate to which said object is fixedly secured, said flat base plate for releasably attaching said object to a floor, and said flat base plate including a pair of laterally spaced apart rear foot anchors that are pivotally mounted to a trailing edge thereof;

a plurality of holes formed in said floor;

a plurality of cover plates, each hole of said plurality of holes being covered by an associated cover plate, there being a pair of rear cover plates and a pair of front cover plates;

each of said rear foot anchors including a rearwardly extending ledge means, each of said ledge means being adapted to releasably engage a predetermined part of an associated rear cover plate;

a tool for effecting rotation of said rear foot anchors to release said ledge means from said predetermined part of their associated rear cover plates;

a pair of ears fixedly secured to a leading edge of said base plate, each of said ears engaging its associated front cover plate to hold down the leading edge of said base plate, and said ears being disengageable from said base plate when said rear foot anchors are pivotally disengaged from their associated rear cover plates;

said tool including a pair of laterally spaced rotatably mounted wheels so that said object is transportable cn said tool after said object has been detached from said floor;

said plurality of cover plates substantially concealing said rear foot anchors from inspection so that how to release said object from said floor is not readily apparent;

whereby unauthorized persons are unable to remove said object and whereby authorized persons having access to said tool may easily remove said object.

2. The object of claim 1, wherein each of said rear foot anchors includes an armature that forms a pivot about which it pivots, and a rod that is spaced downwardly therefrom and disposed parallel thereto.

3. The object of claim 2, wherein said tool includes an armature-engaging member, wherein said armature-engaging member has a slot formed therein that receives said armature and said rod, said armature-engaging member bearing against said rod when said rear foot anchor is pivoted about said armature.

4. The object of claim 3, wherein each of said rear cover plates includes a depending wall that is engaged by said rearwardly extending ledge means when said object is attached to said floor, and wherein each of said rear cover plates is slotted to permit insertion therethrough of said armature-engaging member.

5. The object of claim 4, further comprising a bias means for urging said ledge means to engage said depending wall, said tool overcoming said bias means when said rear foot anchor is pivoted about said armature and said ledge means disengaging from said depending wall when said rear foot anchor is pivoted, said object being released only when said rear foot anchor is pivoted.

6. The object of claim 5, wherein said tool further includes a pair of wheels so that an object separated from the floor is transportable on said tool.

7. A removably mounted chair, comprising:

a plurality of holes formed in a floor;

said plurality of holes including a pair of laterally spaced leading holes and a pair of laterally spaced trailing holes;

a pair of front cover plates for covering their associated leading holes;

a pair of rear cover plates for covering their associated trailing holes;

a base plate fixedly secured to an underside of a flat plate that supports a theater chair post;

said base plate having a pair of ears at its leading edge to releasably engage each of said front cover plates to thereby hold down the leading edge of said base plate;

a pair of rear foot anchors pivotally mounted in depending relation to a trailing edge of said base plate;

each of said rear foot anchors being received within an associated rear cover plate;

each of said rear cover plates having a depending wall formed therein;

each of said rear foot anchors being formed to releasably engage its associated depending wall to thereby hold down the trailing edge of said base plate; and a tool for pivoting each of said rear foot anchors about a pivot point to thereby release each of said rear foot anchors from its associated depending wall to thereby enable lifting of said chair.

8. The chair of claim 7, wherein each of said front cover plates has a horizontal wall and wherein said ears underlie and abuttingly engage their associated horizontal walls to hold down the leading edge of said base plate.

9. The chair of claim 8, wherein a pair of notches are formed in the trailing edge of said base plate, wherein a pair of mounting means are fixedly secured to an underside of said base plate trailing edge on opposite sides of each of said notches, wherein each of said rear foot anchors is bored to receive an armature means therethrough and wherein opposite ends of each armature are pivotally received within an associated mounting means so that each of said rear foot anchors ma pivot about its associated armature when an externally originated force is imparted thereagainst.

10. The chair of claim 9, wherein said tool includes an elongate rod that extends between said rear cover plate depending wall and said armature.

11. The chair of claim 10, wherein said tool further includes a truncate rod that abuts said armature when said elongate rod extends between said depending wall and said armature.

12. The chair of claim 11, wherein said tool includes a handle and a pair of elongate rails having their respective uppermost ends fixedly secured to opposite ends of said handle, said elongate rod and said truncate rod being fixedly secured to a lowermost end of said rails.

* * * * *